US011084647B2

(12) United States Patent
Gadd et al.

(10) Patent No.: US 11,084,647 B2
(45) Date of Patent: Aug. 10, 2021

(54) DISPENSER

(71) Applicant: MARS, INCORPORATED, McLean, VA (US)

(72) Inventors: David Gadd, Chicago, IL (US); John MacDonald, Bristol (GB); Matthew Wright, Bath (GB); Duncan Colquhoun, Bristol (GB); Richard Donaldson, Cumbria (GB); Jake Dale-Brown, Leicester (GB)

(73) Assignee: MARS, INCORPORATED, McLean, VA (US)

( * ) Notice: Subject to any disclaimer, the term of this patent is extended or adjusted under 35 U.S.C. 154(b) by 0 days.

(21) Appl. No.: 16/484,149

(22) PCT Filed: Feb. 8, 2018

(86) PCT No.: PCT/GB2018/050352
§ 371 (c)(1),
(2) Date: Aug. 7, 2019

(87) PCT Pub. No.: WO2018/146476
PCT Pub. Date: Aug. 16, 2018

(65) Prior Publication Data

US 2020/0024063 A1 Jan. 23, 2020

(30) Foreign Application Priority Data

Feb. 9, 2017 (GB) ..... 1702171

(51) Int. Cl.
*B65D 83/04* (2006.01)

(52) U.S. Cl.
CPC .. *B65D 83/0427* (2013.01); *B65D 2583/0472* (2013.01)

(58) Field of Classification Search
CPC ..... B65D 83/0427; B65D 83/04; B65D 83/0409; B65D 83/049
(Continued)

(56) References Cited

U.S. PATENT DOCUMENTS 2,027,670 A * 1/1936 Broeren ..... A47K 10/427 221/55
2,138,692 A * 11/1938 Broeren ..... A47K 10/427 221/35

(Continued)

FOREIGN PATENT DOCUMENTS

EP 1847475 A3 10/2007
EP 2463211 A1 6/2012

(Continued)

*Primary Examiner* — Rakesh Kumar

(57) ABSTRACT

There is disclosed a dispenser (10), such as a confectionery dispenser, for dispensing product objects such as pieces of confectionery (40). The dispenser (10) comprises a container (12) for storing product objects; and at least one dispensing arrangement (14, 16). The dispensing arrangement (14), (16) comprises an opening (18) provided in the container (12); a collection region (26) located within the container (12) and adjacent to the opening (18); a guide (32) disposed within the container (12) and adjacent to the collection region (26); and a dispensing tray (29) disposed within the container (12) and adjacent to the opening (18). The dispensing arrangement (14), (16) is configured the opening (18) and having a dispensing surface 30 accessible through such that in use in a loading orientation of the dispensing arrangement (14), (16) product objects collect in the collection region (26). During movement of the dispensing arrangement (14), (16) from the loading orientation to a dispensing orientation the guide member (32) guides product objects within the collection region (26) so as to dispense them onto the dispensing surface (30) of the dispensing tray (29).

25 Claims, 5 Drawing Sheets

Figure 1:
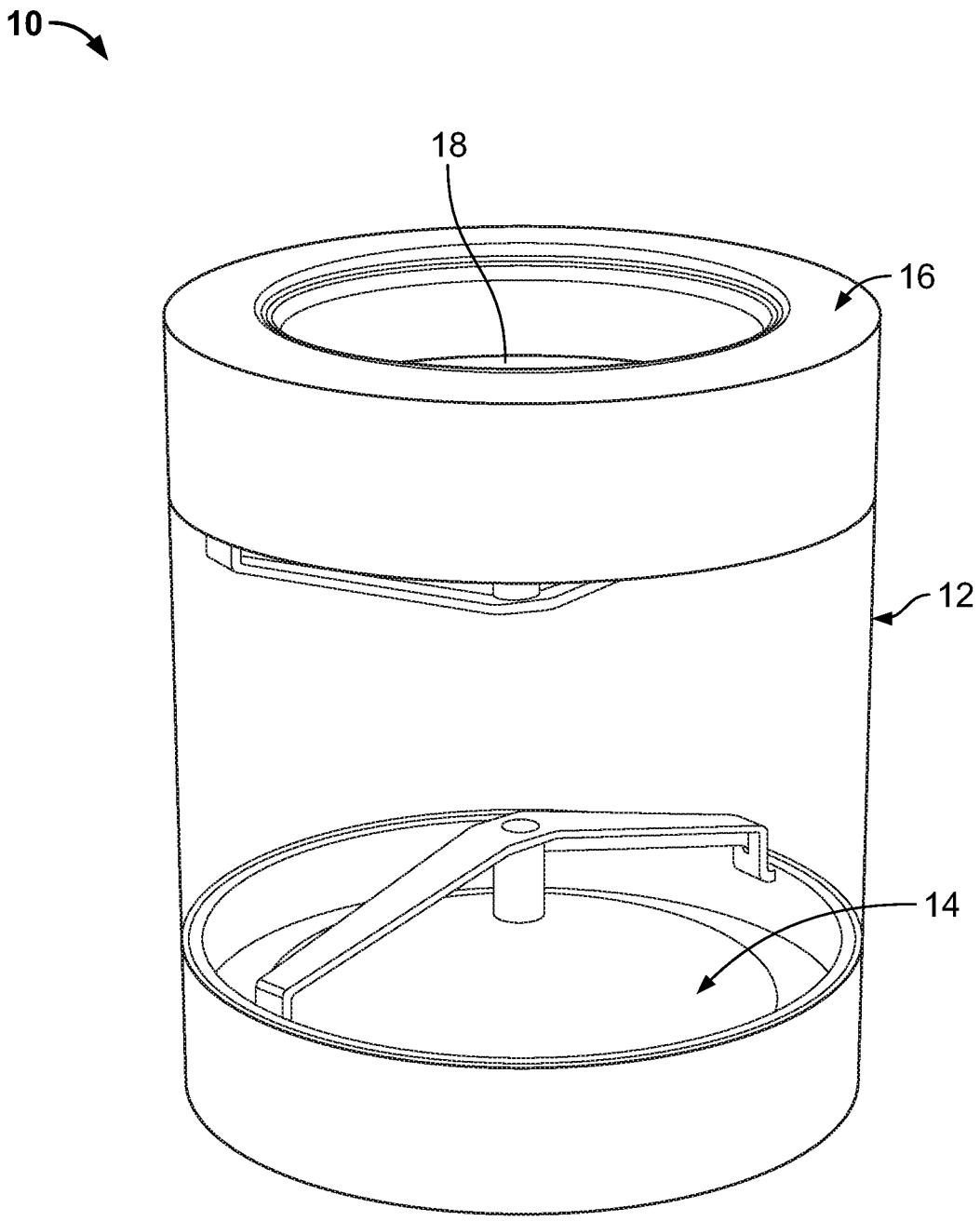

(58) Field of Classification Search
USPC ..... 221/288, 256
See application file for complete search history.

(56) References Cited

U.S. PATENT DOCUMENTS 2,434,206 A * 1/1948 Frieders ..... A47K 10/427 221/35
2,522,427 A * 9/1950 Borden ..... A47K 10/427 221/35
2,563,693 A * 8/1951 Russell ..... G08B 7/068 340/321
2,852,158 A * 9/1958 Jones ..... A47K 10/427 221/35
3,071,289 A * 1/1963 Taylor ..... A47K 10/427 221/59
3,325,052 A * 6/1967 Sauber ..... B65D 83/0409 221/256
3,398,857 A * 8/1968 Alio ..... B65D 83/0427 221/190
4,530,447 A * 7/1985 Greenspan ..... B65D 83/04 221/288
4,653,668 A * 3/1987 Gibilisco ..... B65D 83/0409 206/540
4,811,871 A * 3/1989 Wass ..... B67C 9/00 222/477
5,346,105 A 9/1994 Onneweer
5,482,172 A * 1/1996 Braddock ..... B65D 1/06 215/237
7,533,776 B2 * 5/2009 Nickerson ..... A47B 81/007 211/74
7,559,436 B2 * 7/2009 Bieger ..... G07F 11/44 221/256
7,648,044 B2 * 1/2010 Reinsei ..... A47K 10/426 221/35
9,505,530 B2 * 11/2016 Downey ..... B65D 43/26
2019/0300269 A1 * 10/2019 Park ..... B65D 83/0427
2020/0024063 A1 * 1/2020 Gadd ..... B65D 83/0427

FOREIGN PATENT DOCUMENTS

WO 2011054484 A1 5/2011
WO WO2016037107 * 9/2015 ..... B65D 83/00
WO WO-2016037107 A1 * 3/2016 ..... A47J 47/01

* cited by examiner

DISPENSER

The invention relates to a dispenser for dispensing product objects, such as confectionery pieces, candy pieces, chocolate pieces, pills, or tablets. In particular, although not exclusively, the invention relates to a confectionery dispenser for dispensing pieces of confectionery.

Many different types of dispenser exist for dispensing small product objects such as pieces of confectionery (e.g. candy pieces, chocolate pieces). One previously considered type of confectionery dispenser comprises a container having a flip top lid which can be opened to expose an opening of the container, and which can be closed to seal or close the opening. In order to dispense confectionery the flip top lid is opened and pieces of confectionery are typically tipped into the user's hand. Whilst such a dispenser may be satisfactory, it may be difficult to control the size of the portion dispensed.

It may therefore be desirable to provide an improved dispenser which may provide better control of dispensing.

According to an aspect there is provided a dispenser for dispensing product objects, comprising: a container for storing product objects; and at least one dispensing arrangement comprising: an opening provided in the container; a collection region located within the container and adjacent to the opening; a guide disposed within the container and adjacent to the collection region; and a dispensing tray disposed within the container and adjacent to the opening and having a dispensing surface accessible through the opening; wherein the dispensing arrangement is configured such that in use in a loading orientation of the dispensing arrangement product objects collect in the collection region, and wherein during movement of the dispensing arrangement from the loading orientation to a dispensing orientation the guide member guides product objects within the collection region so as to dispense them onto the dispensing surface of the dispensing tray. The dispensing tray and guide may be separate components or they may be provided by the same part. The dispenser may be generally cylindrical.

The collection region may be an annular collection channel which surrounds the opening. The annular collection channel may be defined by at least an outer annular wall and an inner annular wall. The outer annular wall and/or the inner annular wall may be shaped and/or dimensioned so as to guide product objects. For example, the outer and inner walls may be sloped inwards towards the bottom of the channel. The collection channel may be defined by at least an end wall.

The dispensing tray may define a concave dispensing surface and/or a dispensing surface that is sloped inwards. The concave dispensing surface may be defined by straight and/or curved walls. The dispensing surface may be an inner conical surface. The dispensing surface may be an outer surface.

The dispensing arrangement (or mechanism) may comprise a dispensing member disposed within the container. The dispensing member (or plate) may comprise the dispensing tray and the guide. The dispensing tray and the guide may be integrally formed. A peripheral region (i.e. an edge region) of the dispensing member may form the guide. The inner surface of the dispensing member may be convex and may be defined by straight and/or curved walls. The inner surface of the dispensing member may guide product objects into the collection region. The dispensing member may be separate from the container.

The dispensing member may be moveable between at least a closed position in which it closes the opening and an open position in which a dispensing path between the collection region and the dispensing surface is provided. The dispensing arrangement may be configured such that movement of the dispensing arrangement from the loading orientation to the dispensing orientation causes the dispensing member to move from the closed position to the open position. The dispensing member may be axially and/or linearly moveable between the closed and open positions. The dispensing member may be larger than the opening. The dispensing member may be substantially coaxial with the opening and/or the container.

The dispensing arrangement may be configured such that lateral movement of the dispensing member is prevented or inhibited. The dispensing arrangement may further comprise a support guide. The dispensing member may cooperate with the support guide so as to permit only linear (or axial) movement of the dispensing member. The support guide may comprise a sleeve and the dispensing member may comprises a spindle or shaft which is slidably located within the sleeve. The spindle and/or sleeve may be coaxial with the container.

The dispensing member may be captured (or retained) within an end region of the container and may be moveable therewithin.

The container may comprise a main body, such as a tubular main body, and at least one end cap which is detachably attached thereto. The opening may be provided in the end cap. The dispensing member may be captured between the end cap and the main body.

In the loading orientation of the dispensing arrangement the opening may face downwards. In the dispensing orientation of the dispensing arrangement the opening may face upwards. The loading and dispensing orientations may be 180° apart, and may be about a horizontal axis.

The dispenser may be configured such that movement of the dispensing arrangement between the loading and dispensing orientations is achievable by movement of the dispenser.

The dispenser may comprise first and second dispensing arrangements provided in first and second opposing ends of the container. The dispenser may be configured such that in a first orientation of the dispenser the first dispensing arrangement is in the loading orientation and the second dispensing arrangement is in the dispensing orientation. The dispenser may be configured such that in a second orientation of the dispenser the first dispensing arrangement is in the dispensing orientation and the second dispensing arrangement is in the loading orientation. The first and second orientations may be 180° apart, and may be about a horizontal axis.

The dispenser may be for dispensing product objects such as confectionery pieces, candy pieces, chocolate pieces, pills, or tablets.

According to another aspect there is provided a confectionery dispenser for dispensing pieces of confectionery, comprising: a container for storing pieces of confectionery; and a dispensing mechanism provided in an end of the container and comprising: an opening provided in the end of the container; an annular collection channel located within the container and surrounding the opening; and a dispensing member captured within the end of the container and comprising a concave dispensing surface accessible through the opening and a peripheral guide which overlaps the annular collection channel, wherein the dispensing member is axially moveable between at least a closed position in which it closes the opening and an open position in response to movement of the dispenser between first and second orientations.

According to another aspect there is provided a confectionery dispenser for dispensing pieces of confectionery, comprising: a container for storing pieces of confectionery and comprising first and second opposing ends; a first dispensing mechanism provided in the first end of the container and comprising: a first opening provided in the first end of the container; a first annular collection channel located within the container and surrounding the first opening; and a first dispensing member captured within the first end of the container and comprising a concave dispensing surface accessible through the first opening and a peripheral guide which overlaps the first annular collection channel, wherein the first dispensing member is axially moveable between at least a closed position in which it closes the first opening and an open position in response to movement of the dispenser; and a second dispensing mechanism provided in the second end of the container and comprising: a second opening provided in the second end of the container; a second annular collection channel located within the container and surrounding the second opening; and a second dispensing member captured within the second end of the container and comprising a concave dispensing surface accessible through the second opening and a peripheral guide which overlaps the second annular collection channel, wherein the second dispensing member is axially moveable between at least a closed position in which it closes the second opening and an open position in response to movement of the dispenser.

The invention may comprise any combination of the features and/or limitations referred to herein, except combinations of such features as are mutually exclusive.

Figure 2:
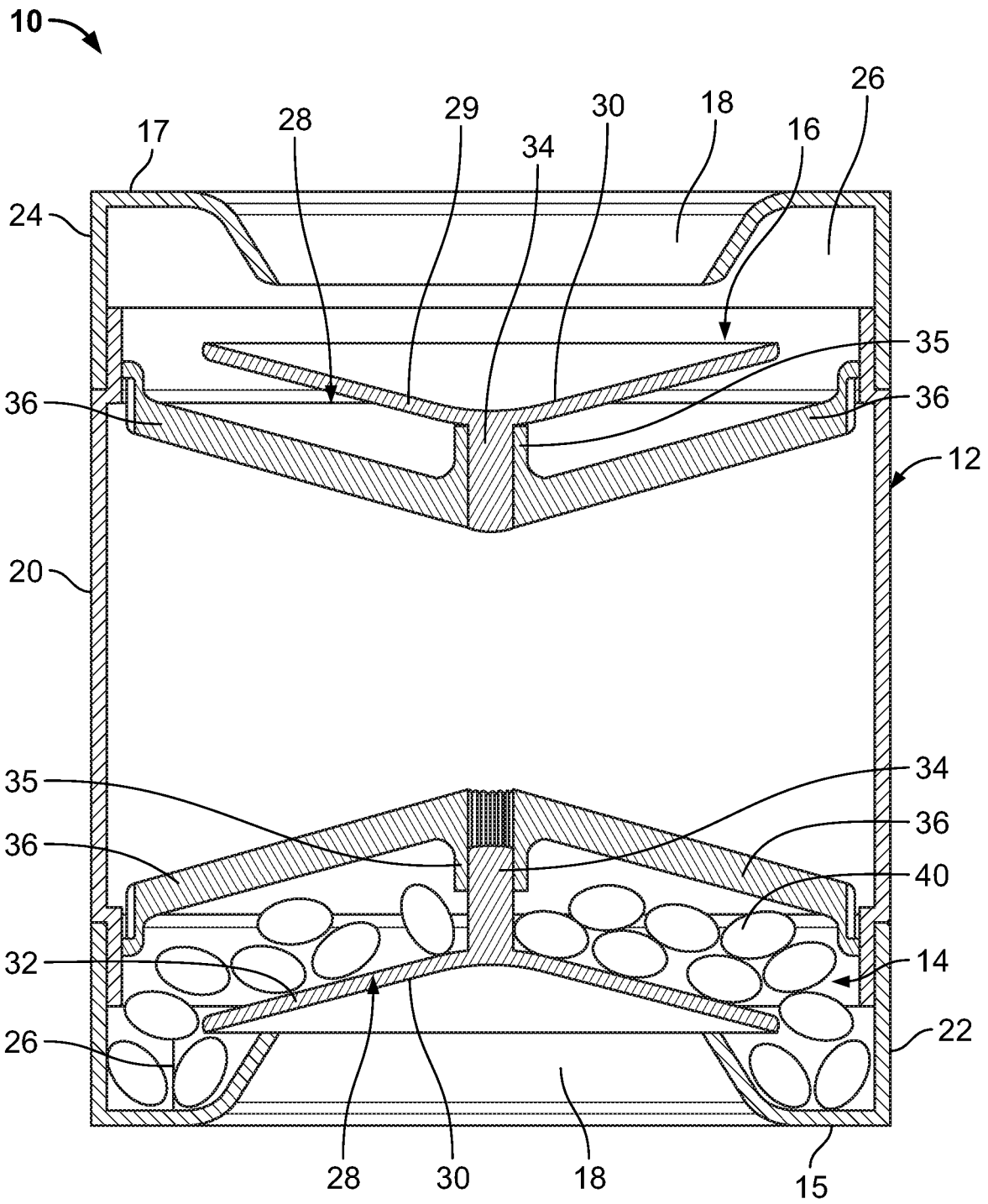
Figure 3:
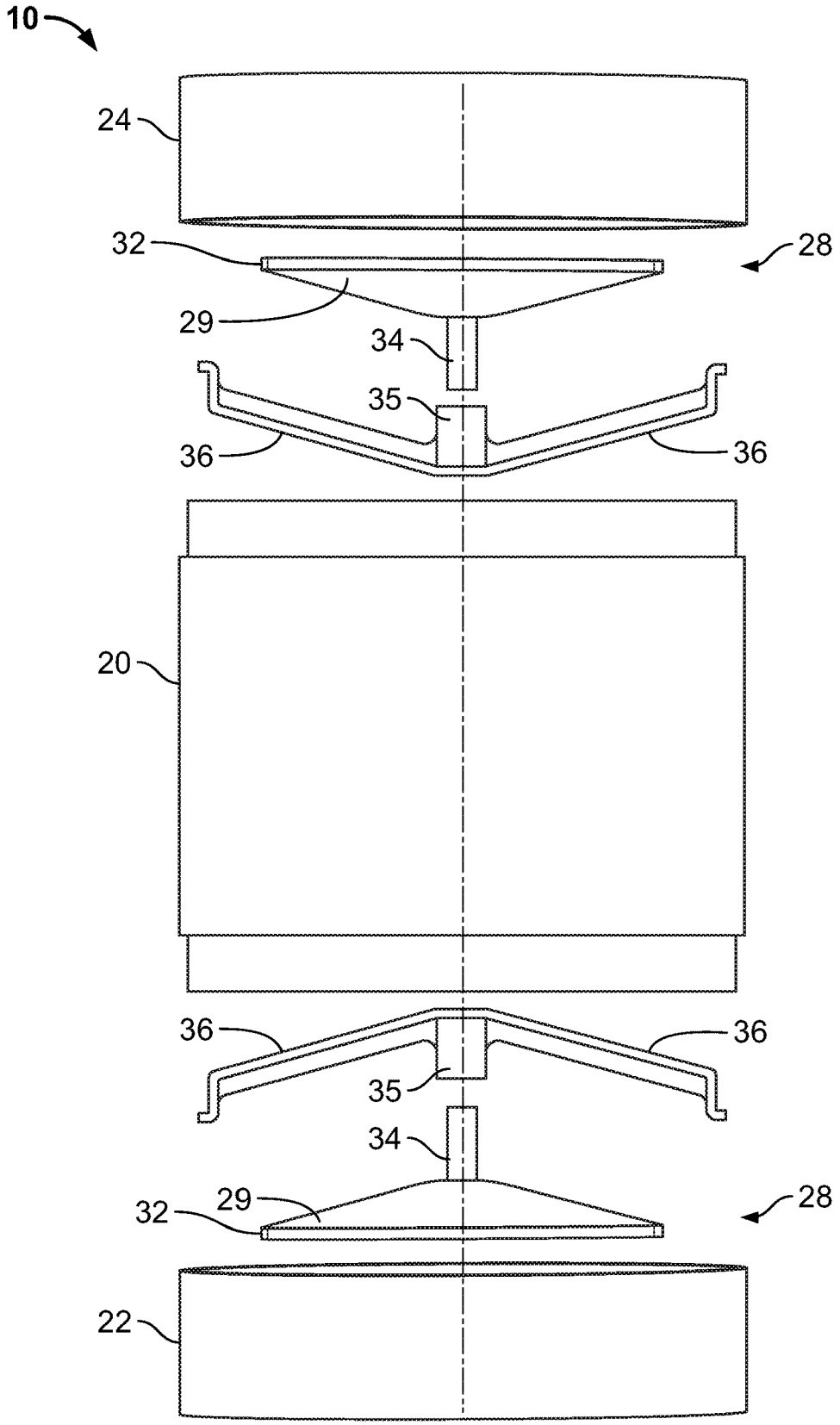
Figure 4:
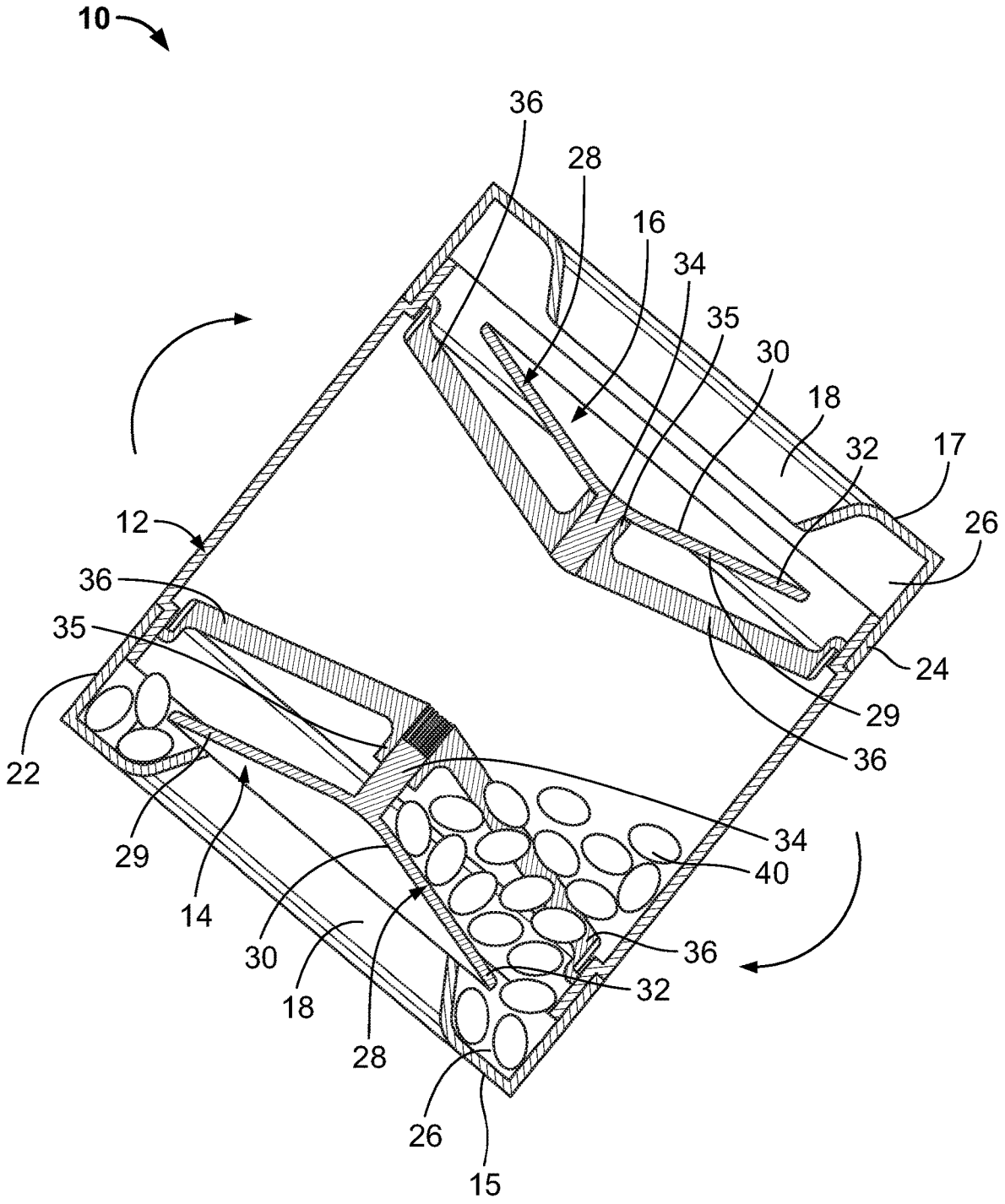
Figure 5:
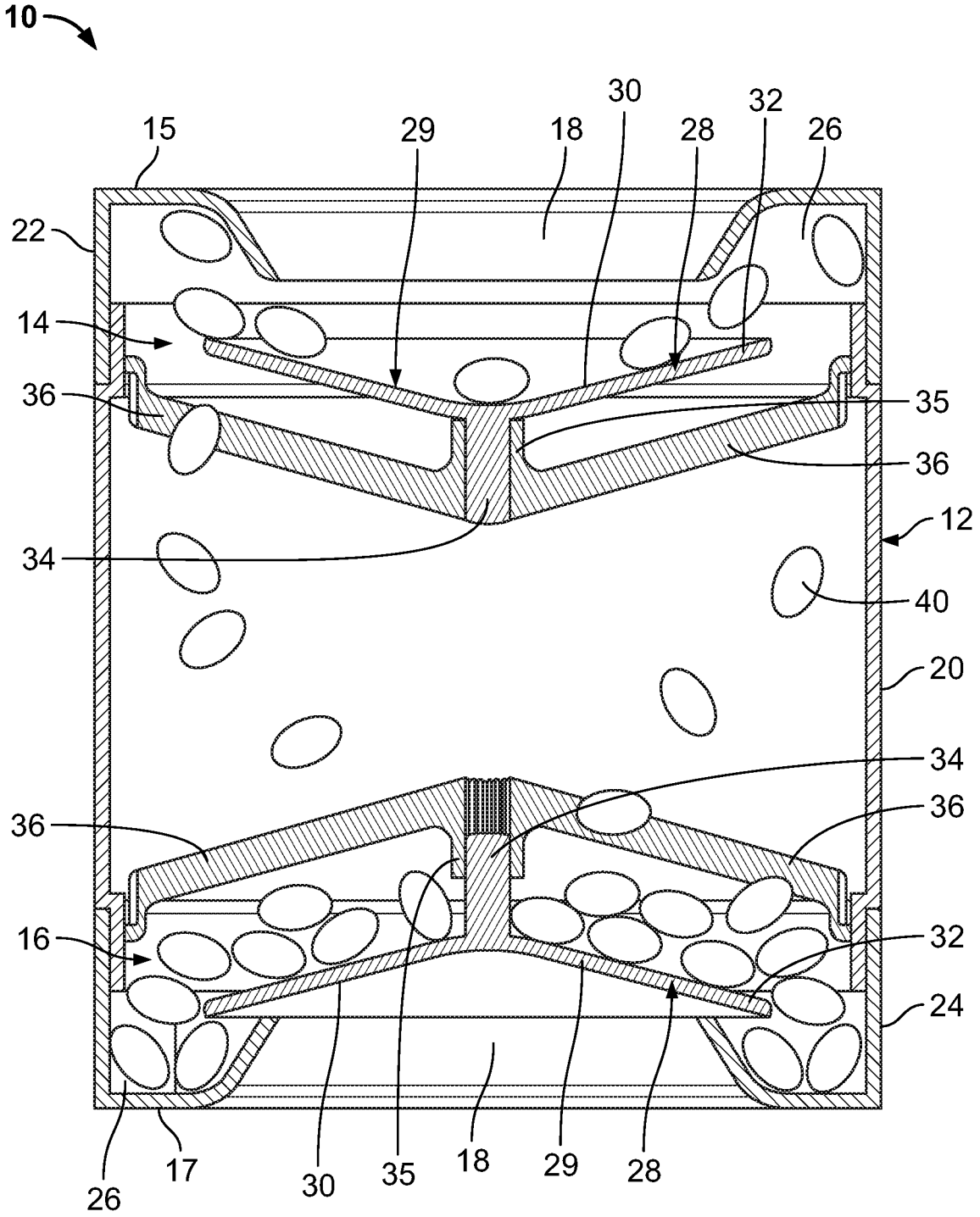

Embodiments of the invention will now be described, by way of example, with reference to the accompanying drawings, in which:

FIG. 1 schematically shows a perspective view of a dispenser;

FIG. 2 schematically shows a cross-sectional view of the dispenser of FIG. 1 in a first orientation;

FIG. 3 schematically shows an exploded view of the dispenser of FIG. 1;

FIG. 4 schematically shows a cross-sectional view of the dispenser of FIG. 1 rotated away from the first orientation; and FIG. 5 schematically shows a cross-sectional view of the dispenser of FIG. 1 in a second orientation.

FIG. 1 shows a dispenser 10 for dispensing small product objects. It the following description it will be described that the dispenser is a confectionery dispenser 10 for dispensing pieces of confectionery, such as chocolate lentils (pieces) or candy pieces.

However, it should be appreciated that the dispenser could be for dispensing any type of small object such as confectionery pieces, candy pieces, chocolate pieces, pills, or tablets. The confectionery dispenser 10 generally comprises a container 12 for storing pieces of confectionery and first and second dispensing arrangements 14, 16 (otherwise referred to as dispensing mechanisms) for dispensing confectionery pieces from the container 12. In this arrangement the first and second dispensing mechanisms 14, 16 are substantially identical and are provided in first and second opposing ends of the container 12. However, it should be appreciated that there may only be a single dispensing mechanism, or two or more dispensing mechanisms that are different to one another. As will be described in detail below, in use, pieces of confectionery can be dispensed from the dispenser 10 by changing the orientation of the dispenser 10.

Referring now to FIGS. 2 and 3, the dispenser 10 is generally cylindrical and has first and second opposing ends 15, 17. The container 12 is configured such that either end of the container can act as a base of the dispenser (i.e. it can stand/rest on either the first or second end). The dispenser 10 can therefore be placed in a first orientation in which the first end 15 of the container 12 acts as the base, and a second orientation in which the second end 17 of the container 12 acts as the base. The first and second orientations are 180° apart such that the dispenser 10 must be rotated through 180° about a horizontal axis to move it between the first and second orientations. The container 12 comprises a main cylindrical tubular body 20 which has threaded first and second ends, and first and second end caps 22, 24 which are threadedly attached to the first and second threaded ends of the main body 20.

As briefly described above, the first and second dispensing mechanisms 14, 16 are substantially identical and therefore only the first dispensing mechanism 14 will be described in detail. It will be appreciated that in this embodiment the second dispensing mechanism 16 has features corresponding to that of the first dispensing mechanism 14. With reference to FIG. 2, the first dispensing mechanism 14 comprises a central opening 18 in the first end cap 22 of the container 12 which is coaxial with the axis of the container 12. The first end cap 22 also defines an annular collection region (or channel) 26 of the dispensing mechanism 14 that surrounds the central opening 18. The annular collection channel 26 is defined by a base wall, an outer annular wall and an inner annular wall which also defines the opening 18. The first dispensing mechanism 14 further comprises a dispensing member (or plate) 28 which is captured within the first end region of the container 12 adjacent to the opening 18. The dispensing plate 28 is larger than the opening 18 and therefore the dispensing plate 28 cannot be removed from the container 12 without removing the end cap 22. In this arrangement the dispensing plate 28 is generally circular and has a concave outer surface and a convex inner surface. In this embodiment the concave and convex surfaces are substantially conical. However, in other arrangements other geometries may be used to define the convex and conical surfaces. Further, in yet other arrangements the dispensing plate 28 may be planar, or may simply have curved edges. The dispensing plate 28 comprises a dispensing tray 29 having a concave dispensing surface 30 which is accessible through the opening 18. The dispensing plate 28 also comprises a guide 32 which in this arrangement is the annular peripheral region of the plate 28 that overlaps the annular collection channel 26. The dispensing plate further comprises a central spindle 34 which projects inwards to the container 12 and which is coaxial with the container 12. The spindle 34 is slidably located within a corresponding sleeve 35 which is supported within the container 12 towards the end of the container with two support arms 36. The cooperation of the spindle 34 and sleeve 35 ensures that the dispensing plate 28 can only move axially and prevents any lateral/radial movement and/or tilting of the dispensing plate 28. The cooperation of the spindle 34 and sleeve 35 ensures that the dispensing plate 28 is centralised within the container 12. Further, the spindle 34 and sleeve 35 means that the dispensing plate 28 can only axially move within an end region of the container 12 between a position in which it is in contact with the end cap 22, and a position in which the underside of the plate 28 abuts the sleeve 35. With dispensing plate 28 in contact with the sleeve 35 a pathway is defined between the opening 18 and the interior of the main body 20.

Although it has been described that the axial movement of the dispensing plate 28 is achieved by a spindle within a sleeve, it should be appreciated that other arrangements could be provided for restricting the movement of the dispensing plate 28. For example, the dispensing plate 28 could be provided with one or more projections or fins which cooperate with an annular shoulder to limit the movement of the dispensing plate 28.

Referring still to FIG. 2, the first and second dispensing mechanisms 14, 16 each have a loading orientation and a dispensing orientation. The loading and dispensing orientations are 180° apart about a horizontal axis. Since the first and second dispensing mechanisms 14, 16 are oriented 180° apart, when the first dispensing mechanism 14 is in the loading orientation the second dispensing mechanism 16 is in the dispensing orientation (FIG. 2) and vice versa. In the loading orientation of the dispensing mechanism 14, 16 the opening 18 faces downwards and the dispensing plate 28 is in a closed position in which it sits over the opening 18 and the guide 32 overlaps the annular collection channel 26. In the dispensing orientation of the dispensing mechanism 14, 16 the opening 18 faces upwards and the dispensing plate 28 is in an open position in which it is spaced from the opening 18 and the underside of the dispensing plate 28 rests on the spindle 35.

In use, the container 12 is filled with pieces of confectionery 40 such as chocolate lentils. This may be done by unscrewing one of the end caps 22, 24 and removing the respective dispensing plate 28. Once filled, the end cap 22 and dispensing plate 28 are replaced. Referring to FIG. 2, the dispenser 10 may then be placed in a first orientation in which it rests on the first end 15 such that the first dispensing mechanism 14 is in a loading orientation and in which the second dispensing mechanism 16 is in a dispensing orientation. With the first dispensing mechanism 14 in a loading orientation the dispensing plate 28 is in the closed position in which it closes the opening 18. The confectionery pieces 40 fall towards the bottom of the container 12 under gravity and bear against the inner surface of the dispensing plate 28. In the loading orientation of the first dispensing mechanism 14 a plurality of confectionery pieces 40 (for example approximately 12 confectionery pieces) collect in the annular collection channel 26. The inner geometry of the container 12 and the convex inner surface of the dispensing plate 28 may assist in guiding the confectionery pieces into the collection channel 26. As shown, confectionery pieces 40 may be partly trapped under the peripheral guide 32 of the dispensing plate 28. Referring now to FIGS. 4 and 5, in order to dispense a plurality pieces of confectionery the dispenser 10 is rotated through 180° about a horizontal axis. As the dispenser 10 is rotated, at least some of the confectionery pieces 40 within the collection channel 26 of the first dispensing mechanism 14 are trapped within the collection channel 26 by the peripheral guide 32 of the dispensing plate 28. As the dispenser 10 is further rotated the dispensing plate 28 axially moves away from the closed position to an open position in which it is spaced from the opening 18 and defines a pathway between the collection channel 26 and the dispensing surface 30 of the dispensing tray 29. As the dispensing plate 28 moves to the open position the peripheral guide 32 guides a plurality of pieces of confectionery onto the dispensing surface 30 of the dispensing tray 29. As the dispensing plate 28 moves to the open position, the size of the gap between the peripheral guide 32 and the inner surface of the container 12 may reduce such that confectionery pieces are prevented or restricted from falling downwards into the main part of the container 12. The convex nature of the dispensing surface 30 further guides the confectionery pieces towards the centre of the dispensing tray 29. Once the dispenser 10 has been fully rotated by 180° it may be placed on the second end 17 with the first dispensing mechanism 14 in the dispensing orientation in which pieces of confectionery 40 are presented on the dispensing surface 30 of the dispensing tray 29 where they can be picked off one-by-one for consumption. As will be appreciated, with the first dispensing mechanism 14 in the dispensing orientation, the second dispensing mechanism 16 is in the loading orientation in which pieces of confectionery collect in the collection channel 26. Thus, a further rotation of 180° returns the dispenser 10 to the orientation shown in FIG. 2 and causes the second dispensing mechanism 16 to dispense confectionery pieces onto the dispensing surface 30 of the dispensing tray 29. The dispenser 10 can be repeatedly rotated to dispense pieces of confectionery until the dispenser 10 is empty.

Once all of the pieces of confectionery 40 have been dispensed from the container 12 the container 12 may be refilled. This may be achieved by unscrewing one of the end caps 22, 24 removing the dispensing plate 28 and then refilling the container. It should be appreciated that in other arrangements the dispenser 10 may be arranged for single use and is therefore not refillable.

Advantageously, the dispenser 10 is of a relatively simple construction has few moving parts which results in a reduced manufacturing and assembly cost. Further, the reliability of the dispenser 10 may be improved when compared to prior art arrangements.

Although it has been described that the dispensing plate 28 (otherwise referred to as a dispensing member) is moveable, in other arrangements the dispensing plate 28 may be fixed within the container 10. The dispensing plate 28 could thus be part of one of the end caps 22, 24 and may be removable from the container 12 to permit refill. In yet another arrangement the dispensing tray 29 defining the dispensing surface 30 and the guide 32 could be separate components as opposed to being defined by a single dispensing plate 28. For example, in one arrangement the dispensing tray 29 could be fixed over the opening 18 and the guide 32 could also be fixed, or could be moveable with respect to the tray 29 and the opening 18 between a closed loading position, and an open dispensing configuration in which it guides product objects onto the dispensing tray 29.

It should be appreciated that the dimensions and/or geometry of various components of the dispenser 10 are chosen based on the dimensions of the product objects, such as pieces of confectionery, to be dispenser.

The invention claimed is:

1. A dispenser for dispensing product objects, comprising:

a container for storing product objects; and at least one dispensing arrangement comprising:

an opening provided in the container;

a collection region located within the container and adjacent to the opening;

a guide disposed within the container and adjacent to the collection region; and a dispensing tray disposed within the container and adjacent to the opening and having a dispensing surface accessible through the opening;

wherein the dispensing arrangement is configured such that in use in a loading orientation of the dispensing arrangement product objects collect in the collection region and the dispensing tray is in a closed position that closes the opening, and wherein during movement of the dispensing arrangement from the loading orientation to a dispensing orientation the dispensing tray is in an open position that is spaced from the opening and allows the guide to guide product objects from within the collection region so as to dispense them onto the dispensing surface of the dispensing tray.

2. A dispenser according to claim 1, wherein the collection region is an annular collection channel which surrounds the opening.

3. A dispenser according to claim 1, wherein the dispensing tray defines a concave dispensing surface.

4. A dispenser according to claim 1, wherein the dispensing arrangement comprises a dispensing plate disposed within the container, the dispensing plate comprising the dispensing tray and the guide.

5. A dispenser according to claim 4, wherein a peripheral region of the dispensing plate forms the guide.

6. A dispenser according to claim 4, wherein the dispensing plate is separate from the container.

7. A dispenser according to claim 4, wherein the dispensing plate is moveable between at least a closed position in which it closes the opening and an open position in which the dispensing plate is spaced from the opening.

8. A dispenser according to claim 7, wherein the dispensing arrangement is configured such that movement of the dispensing arrangement from the loading orientation to the dispensing orientation causes the dispensing member to move from the closed position to the open position.

9. A dispenser according to claim 7, wherein the dispensing plate is axially moveable between the closed and open positions.

10. A dispenser according to claim 7, wherein the dispensing arrangement is configured such that lateral movement of the dispensing plate is prevented.

11. A dispenser according to claim 7, wherein the dispensing arrangement further comprises a spindle slideably located within a corresponding sleeve, so as to permit only linear movement of the dispensing plate.

12. A dispenser according to claim 7, wherein the dispensing plate is located within an end region of the container and is moveable therewithin.

13. A dispenser according to claim 1, wherein the container comprises a main body and at least one end cap which is detachably attached thereto and wherein the opening is provided in the end cap.

14. A dispenser according to claim 13, wherein the dispensing plate is captured between the end cap and the container.

15. A dispenser according to claim 1, wherein in the loading orientation of the dispensing arrangement the opening faces downwards, and wherein in the dispensing orientation of the dispensing arrangement the opening faces upwards.

16. A dispenser according to claim 1, wherein the loading and dispensing orientations are 180° apart.

17. A dispenser according to claim 1, wherein the dispenser is configured such that movement of the dispensing arrangement between the loading and dispensing orientations is achievable by movement of the dispenser.

18. A dispenser according to claim 1, wherein the dispenser comprises first and second dispensing arrangements provided in first and second opposing ends of the container.

19. A dispenser according to claim 18, wherein the dispenser is configured such that in a first orientation of the dispenser the first dispensing arrangement is in the loading orientation and the second dispensing arrangement is in the dispensing orientation, and wherein in a second orientation of the dispenser the first dispensing arrangement is in the dispensing orientation and the second dispensing arrangement is in the loading orientation.

20. A dispenser according to claim 19, wherein the first and second orientations are 180° apart.

21. A dispenser according to claim 1, wherein the dispenser is for dispensing product objects such as confectionery pieces, candy pieces, chocolate pieces, pills, or tablets.

22. A confectionery dispenser for dispensing pieces of confectionery, comprising:

a container for storing pieces of confectionery; and a dispensing mechanism provided in an end of the container and comprising:

an opening provided in the end of the container;

an annular collection channel located within the container and surrounding the opening; and a dispensing tray captured within the end of the container and comprising a concave dispensing surface accessible through the opening and a peripheral guide which overlaps the annular collection channel, wherein the dispensing tray is axially moveable between at least a closed position in which it closes the opening in a loading orientation and an open position in which the dispensing tray is in an open position that is spaced apart from the opening in a dispensing orientation in response to movement of the dispenser.

23. A confectionery dispenser for dispensing pieces of confectionery, comprising:

a container for storing pieces of confectionery and comprising first and second opposing ends;

a first dispensing mechanism provided in the first end of the container and comprising:

a first opening provided in the first end of the container;

a first annular collection channel located within the container and surrounding the first opening; and a first dispensing plate captured within the first end of the container and comprising a concave dispensing surface accessible through the first opening and a peripheral guide which overlaps the first annular collection channel, wherein the first dispensing plate is axially moveable between at least a closed position in which it closes the first opening and an open position in response to movement of the dispenser; and a second dispensing mechanism provided in the second end of the container and comprising:

a second opening provided in the second end of the container;

a second annular collection channel located within the container and surrounding the second opening; and a second dispensing plate captured within the second end of the container and comprising a concave dispensing surface accessible through the second opening and a peripheral guide which overlaps the second annular collection channel, wherein the second dispensing plate is axially moveable between at least a closed position in which it closes the second opening and an open position in response to movement of the dispenser.

24. A dispenser for dispensing product objects, comprising:

a container for storing product objects; and at least one dispensing arrangement comprising:

an opening provided in the container;

a collection region located within the container and adjacent to the opening;

a guide disposed within the container and adjacent to the collection region; and a dispensing tray disposed within the container and adjacent to the opening and having a dispensing surface accessible through and spaced from the opening;

wherein the dispensing arrangement is configured such that in use in a loading orientation of the dispensing arrangement product objects collect in the collection region, and wherein during movement of the dispensing arrangement from the loading orientation to a dispensing orientation the guide member guides product objects within the collection region so as to dispense them onto the dispensing surface of the dispensing tray;

wherein the dispenser is configured such that in a first orientation of the dispenser a first dispensing arrangement is in the loading orientation and a second dispensing arrangement is in the dispensing orientation, and wherein in a second orientation of the dispenser the first dispensing arrangement is in the dispensing orientation and the second dispensing arrangement is in the loading orientation.

25. A dispenser according to claim 24, wherein the first and second orientations are 180° apart.

* * * * *